United States Patent [19]

Willis

[11] Patent Number: 4,942,386

[45] Date of Patent: Jul. 17, 1990

[54] INTEGRATED IMPACT DETECTION AND ALARM SYSTEM

[76] Inventor: Billy R. Willis, 20219 Londelius St., Canoga Park, Calif. 91306

[21] Appl. No.: 285,777

[22] Filed: Dec. 16, 1988

[51] Int. Cl.[5] ..... G08B 13/00; H01H 35/02

[52] U.S. Cl. ..... 340/566; 200/61.49

[58] Field of Search ..... 340/566, 429, 669, 690, 340/689, 323 R; 273/121 A; 73/654, 652; 33/366; 200/61.45 R, 61.48, 61.49, 61.51, 61.52; 379/40

[56] References Cited

U.S. PATENT DOCUMENTS

| | | | |
|---|---|---|---|
| 3,710,051 | 1/1973 | Orlando | 200/61.45 R |
| 3,731,022 | 5/1973 | Loftus | 200/61.49 |
| 4,030,555 | 6/1977 | Boyce et al. | 273/121 A X |
| 4,297,690 | 10/1981 | Baker | 340/690 |
| 4,418,337 | 11/1983 | Bader | 340/566 X |
| 4,450,326 | 5/1984 | Ledger | 340/566 X |
| 4,583,082 | 4/1986 | Naylor | 340/545 |
| 4,596,203 | 6/1986 | Lorek | 116/215 |
| 4,622,541 | 11/1986 | Stockdale | 340/566 |
| 4,679,033 | 7/1987 | Hwang | 340/566 |
| 4,689,997 | 9/1987 | Windisch | 73/652 |

*Primary Examiner*—Joseph A. Orsino
*Assistant Examiner*—Thomas J. Mullen, Jr.
*Attorney, Agent, or Firm*—David O'Reilly

[57] ABSTRACT

An impact sensing and alarm system having a dual adjustment impact system and alarm circuit for activating selected alarm devices in conjunction with tamper switches connected to provide additional protection to critical areas of a machine. The impact sensor provides dual sensitivity with an adjustable conically tapered spring circumjacent an adjustable threaded contact. The spring is adjustable for coarse setting of the impact loading range and is then fixed. The threaded contact is adjustable to fine tune the threshold sensitivity. An alarm circuit is provided which is constructed to activate visible, audible or silent remote alarms. The impact alarm system is encapsulated to prevent access except to the adjustable threaded contact, and is simple and compact enough to be adaptable to protect any coin-operated or other electronic device.

18 Claims, 3 Drawing Sheets

INTEGRATED IMPACT DETECTION AND ALARM SYSTEM

FIELD OF THE INVENTION

This invention relates to alarm systems including an impact alarm, and more particularly relates to an impact alarm having a unique impact sensing device.

BACKGROUND OF THE INVENTION

A variety of coin operated game machines use motion sensors to detect tampering with the game. For example, pinball machines use a pendulum suspended in a ring to detect changing the angle of the machine to obtain a competitive advantage. If excess motion of the machine occurs, the pendulum contacts the ring, thus disabling the machine. However, these detectors are simply to prevent a player from gaining a competitive advantage and are not used to detect someone tampering with or invading the coin box to remove the coins. These types of devices are used in pinball game-type machines to sense excessive motion of the machine and register a "tilt" if the machine is sufficiently jostled to cause the pendulum to make contact with the conductive ring. Such contact will interrupt operation of the machine which is indicated by a "tilt" signal.

Motion alarms are also used in automobile theft alarm systems. Excessive motion when tampering with or trying to illegally enter an automobile will set off these alarms. The difficulty with these systems is that they must be correctly mounted to function properly. That is, correct mounting of these systems is critical. They must be properly oriented or perfectly level when mounted. The same applies to tilt alarms used in present pinball machines which become much too sensitive if the pendulum, which is operated by gravity, is not correctly oriented in the center of the contact ring. This will cause the alarm to be entirely too sensitive. It would be advantageous if an alarm could be designed and constructed which would be completely independent of any critical mounting, thereby allowing installation in any orientation and environment. That is, a system which can function efficiently independent of the type or orientation of mounting would be particularly advantageous.

There are also various impact sensing devices for specific applications. One such device disclosed in U.S. Pat. No. 3,833,094 is an alarm system activated when a shock absorber is extended beyond a predetermined operating range. Another device disclosed in U.S. Pat. No. 3,282,096 is for testing miniature relays in which the system tests the minimum and maximum pressures exerted by contact springs of the relays. The system is specifically intended to test the springs of relays.

Another spring activated device in U.S. Pat. No. 4,086,809 is directed to a system for measuring the changes in spring loading in a pressure relief valve or other spring loaded device. The pressure changes in valve may rise as a result of aging or high temperature. These changes are detected by monitoring the longitudinal vibration mode resident frequency, as well as changes in loading, by monitoring the transfer or tortional vibration mode resident frequency.

Specific applications of similar but unrelated devices are also disclosed in U.S. Pat. Nos. 3,421,369 and 3,725,455. None of the above patents, however, teach or suggest a completely self-contained impact sensing system which is readily adaptable to existing coin operated machines or devices.

These types of sensors would not be suitable for use as an impact sensor to detect tampering with or preventing theft from a coin operated machine as they are not readily or easily adjusted to detect an impact. Further, different machines would require different impact sensing. Some machines, for example, might be subjected occasionally to impacts such as coin telephones where lifting the receiver or replacing the receiver results in some impact to the machine. It would be advantageous if an impact sensing system could be provided that would be widely adaptable to a variety of coin operated machines.

It is therefore one object of the present invention to provide a unique impact sensing device having a wide range of applications which is packaged for installation in existing coin operated or other electronic machines.

Another object of the present invention is to provide a unique integrated impact alarm and detection system which will function efficiently independently of the manner in which it is mounted. That is, it can be mounted in any position or orientation and yet will function perfectly.

Yet another object of the present invention is to provide a unique impact sensing device in the form of an impact sensor spring secured at one end and having a freely movable non-secured tapered conical shape at the opposite end.

Still another object of the present invention is to provide a three-way impact alarm and detection system having three ways to detect various types of tampering or illegal invasion of coin operated machines. In addition to an impact detector, switches positioned to detect certain types of tampering are provided, with one being a priority switch to set off a remote alarm to summon authorities. These two switch alarms function in conjunction with the impact alarm to provide complete protection from all types of tampering.

Still another object of the present invention is to provide an impact sensing device having a unique conically tapered spring for providing a wide range of coarse adjustments on the impact sensor with a freely movable conically tapered end positioned adjacent to an adjustable contact.

Yet another object of the present invention is to provide the impact sensing device with an alarm activating electrical circuit adaptable to a wide variety of coin operated or other electronic machines.

Still another object of the present invention is to provide an impact sensor having a unique sensing device in combination with an electrical circuit which will activate a audible, visible or silent remote alarm.

Yet another object of the present invention is to provide an impact alarm having a conically tapered spring adjustably positioned circumjacent an adjustable contact in combination with an electrical circuit which will provide a wide variety of applications.

Yet another object of the present invention is to provide a unique impact sensing system completely enclosed and encapsulated with the impact sensor having a preset coarse adjustment and an externally available fine adjustment.

BRIEF DESCRIPTION OF THE INVENTION

The purpose of the present invention is to provide a three-way detection and alarm system having a unique impact sensor in an encapsulated package which can be readily adapted to any existing electronic machines, and in particular coin operated machines.

The present invention provides an impact sensor that has a wide range of impact sensitivity provided by a deflectable spring having a conically tapered portion. The length of the spring is adjustable to position a conically tapered portion adjacent to a electrical contact. The contact itself is made adjustable so that after installation the sensitivity level can then be adjusted to minimize false alarms. This adjustment would be made to prevent the system from detecting normal impacts to the machine. Only any impact occurring above the normal use would be sensed and the alarm set off. Impacts that might result in tampering or breaking into the coinbox of the machine could be determined and the sensitivity level adjusted accordingly.

The impact sensor system of the present invention provides these features with a unique impact sensor in the form of an adjustable spring having a cylindrical end threadable into a threaded hole and a freely movable conically tapered end. The length of the spring is adjustable and after a coarse adjustment can be secured. An adjustable contact is positioned adjacent the freely movable or deflectable conical end so that a shank portion can be adjusted with respect to the freely deflectable conically tapered end of the spring. The impact sensor is connected to an alarm circuit to act as a switch for activating the alarm circuit when subjected to a load exceeding a maximum preset vibration sensitivity.

The impact sensor is encapsulated in an enclosure with an electronic circuit and is connected directly to a voltage source of a coin operated machine or other electronic device. Sufficient impact on the machine in which the system is installed beyond a preset threshold level which cause the spring to vibrate impacting on the shank of the adjustable contact to activate the alarm circuit. Impact of the spring on the adjustable contact connected to the electrical alarm circuit completes a circuit to activate the alarm. Depending upon the particular environment of the coin operated machine or other electronic device the sensor is used for, a coarse adjustment is provided by positioning the conically tapered freely moving end of the spring. The adjustable contact and spring are then incorporated into the electronic alarm circuit by connecting the appropriate ends to the circuit. The adjustable contact may then be adjusted to set the threshold level for activation of the impact sensor.

The electronic circuit is a three-way alarm circuit designed to activate a visible alarm in the form of a light or LED, and an audible alarm in the form of a buzzer, siren or other suitable sound. In addition to the impact sensor, alarm switches are provided to detect unauthorized access to critical areas of a machine being protected, such as an entrance door or coin box. An additional circuit is provided to activate a silent alarm or trigger an automatic dialer to dial a preprogrammed telephone number and deliver a message to summon help. One of the alarm switches is selected as a priority switch to protect the most critical area of the machine, such as the coin box.

The above and other features of this invention will be fully understood from the following detailed description and the accompanying drawings, in which:

DETAILED DESCRIPTION OF THE INVENTION

Figure 1A:
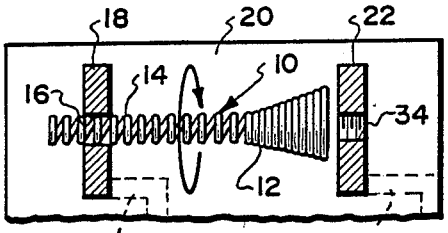
FIGS. 1(*a*) through 1(*c*) illustrate the mounting and adjustment of the unique conically tapered spring of the impact sensor.
Figure 1B:
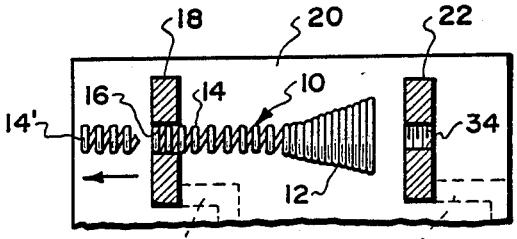
Figure 1C:
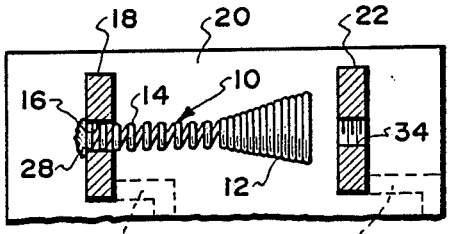

A unique feature of the invention is the use of a deflectable spring for an impact sensor, as shown in FIGS. 1(*a*) through 1(*c*) and 2(*a*) through 2(*c*), along with alarm switches to provide a complete integrated multiple detection alarm system for coin operated electronic machines. The impact sensor for the impact sensing and alarm system has a unique deflectable spring 10 having a tapered conical portion 12 at one end, and a cylindrical portion 14 at the other end threaded into a hole 16 in a bracket 18 mounted on a printed circuit board 20. Opposite the tapered conical portion 12 of spring 10 is a second bracket 22 for mounting an adjustable contact. Brackets 18 and 22 are made of conductive material and are connected to the printed circuit on printed circuit board at 24 and 26, respectively, as will be described in greater detail hereinafter.

Deflectable spring 10 provides a coarse adjustment for the circuit according to the particular machine it is to be used in. The impact sensor detects impact on a device having a coinbox that might be invaded by a thief. The higher the impact the machine can take the lower the sensitivity the impact sensor should be adjusted for. In contrast, machines that are relatively unstable and easily jarred would need a higher threshold of sensitivity to prevent or minimize false alarms. Further, machines such as games that are subject to frequent low level impacts would have a coarse higher threshold of sensitivity.

An important aspect of the invention is that the entire system be compact for use in a wide variety of coin operated machines, and in addition be adaptable to a wide range of impact sensing. For that reason the system utilizes a deflectable spring having a conically tapered portion whose position is adjustable with respect to an adjustable contact. The adjustable contact is in the form of a threaded adjustable screw having its shank threaded into a bracket also mounted on the printed circuit board near the deflectable spring. The shank of the screw can be adjusted relative to the conically tapered portion of the spring to vary the threshold sensitivity of the impact sensor.

Once the particular coarse adjustment has been determined the deflectable spring 10 is threaded into hole 16 and end 14' is removed. Cylindrical portion 14 of the deflectable spring is then soldered, as shown at 28, to conductive bracket 18, as shown in FIG. 1(*c*).

Figure 2A:
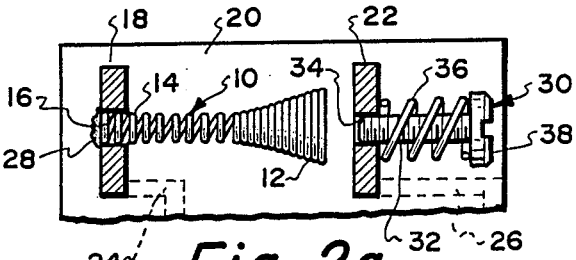
FIGS. 2(*a*) through 2(*c*) illustrate the mounting of an adjustable contact and adjustment of the threshold sensitivity of the impact sensor.
Figure 2B:
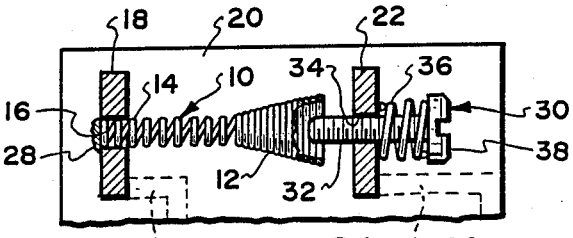
Figure 2C:
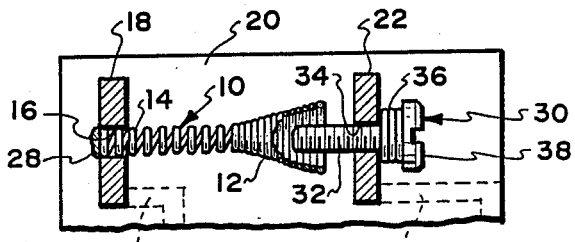

FIG. 2 illustrates installation of the adjustable contact in the form of screw 30 having shank 32 threaded into hole 34 in conductive screw mounting bracket 22. Spring 36 maintains the position of shank 32 after adjustment to prevent loosening over a period of time.

Adjustment of the position of the screw 30 is illustrated in FIGS. 2(*b*) and 2(*c*). By tightening down the head of contact screw 30 the shank 32 can be moved into or out of tapered conical portion 12 of deflectable spring 10. The more screw 30 is threaded into conical tapered portion 12 of spring 10, the lower the threshold level, and higher the sensitivity of the impact sensor. Screw 30 is shown completely bottomed-out in FIG. 2(*c*) with shank 32 fully extended into conically tapered portion 12 of deflectable spring 10 for maximum sensitivity.

Figure 3:
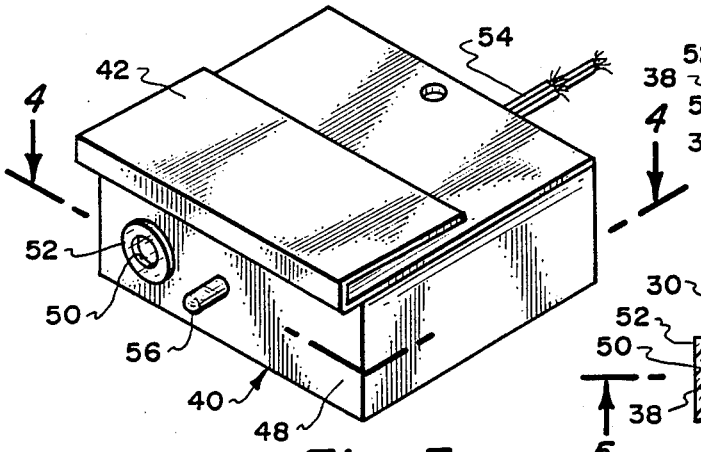
FIG. 3 illustrates a packaged impact sensing system for installation in coin operated machines.
Figure 4:
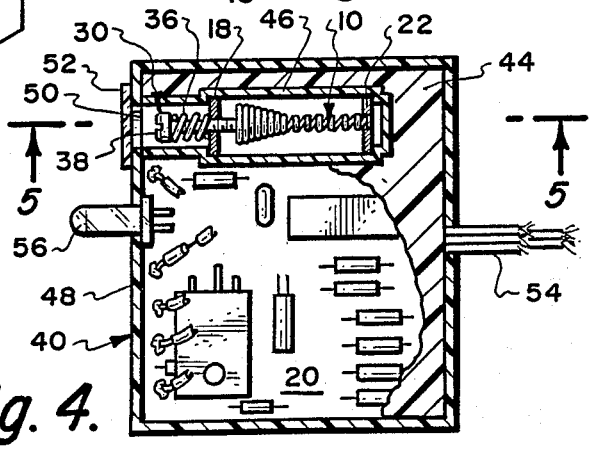
FIG. 4 is a sectional view of the impact sensing system taken at 4—4 of FIG. 3.

The position of the adjustable contact formed by screw 30 is preset at some nominal threshold level before installation of the system in a coin operated machine. After installation of the impact sensor on the printed circuit board, the system is mounted in an enclosure 40, as shown in FIGS. 3 and 4. Enclosure 40 is provided with clip 42 for mounting in a suitable place inside a machine to be protected. The printed circuit board 20 is mounted inside the enclosure and is protected by a insulating potting material 44 completely sealing the circuit.

The impact sensor comprised of spring 10 and adjustable screw 30 are protected by a cover 46 which protects the spring from the environment. Cover 46 and outer casing 48 of enclosure 40 have matching holes 50 providing access to adjustment screw 30. Access hole 50 is protected by a adhesive lift-off plastic cover 52 to provide access to adjustment screw 30. Connecting wires 54 connect the circuit on printed circuit board 20 to the appropriate voltages in the coin operated machine. Lamp 56 extending through the wall of case 48 provides a visible test of the circuit on printed circuit board 20 after installation.

Figure 5:
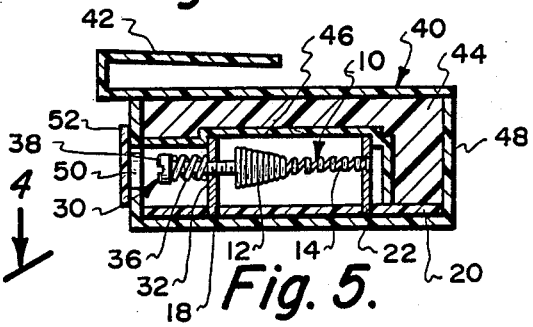
FIG. 5 is a sectional view of the impact sensing system taken at 5—5 of FIG. 4.

Cover 46 as illustrated in FIG. 5 fits snuggly down over contacts 18 and 22 against printed circuit board 20 to completely enclose deflectable spring 10 and adjustable contact screw 30 preventing any spring damage or invasion of the potting material 44 filling enclosure 40. Cover 46 thus protects deflectable spring 10 and contact screw 30 from tampering and also from the environment. Opening 50 providing access to adjust contact screw 30 is sealed with an adhesive plastic sheet 52 pressed over the hole. It can be easily peeled back to provide access to the hole 50 or adjustment of the screw 30 to vary the threshold sensitivity of the impact sensing system. This will not be done on a frequent basis once the system is installed in a coin operated machine. Enclosure 40, printed circuit 20 and impact sensor comprised of deflectable spring 10 and contact screw 30 a very compact unit easily installed in existing coin operated machines.

Figure 6:
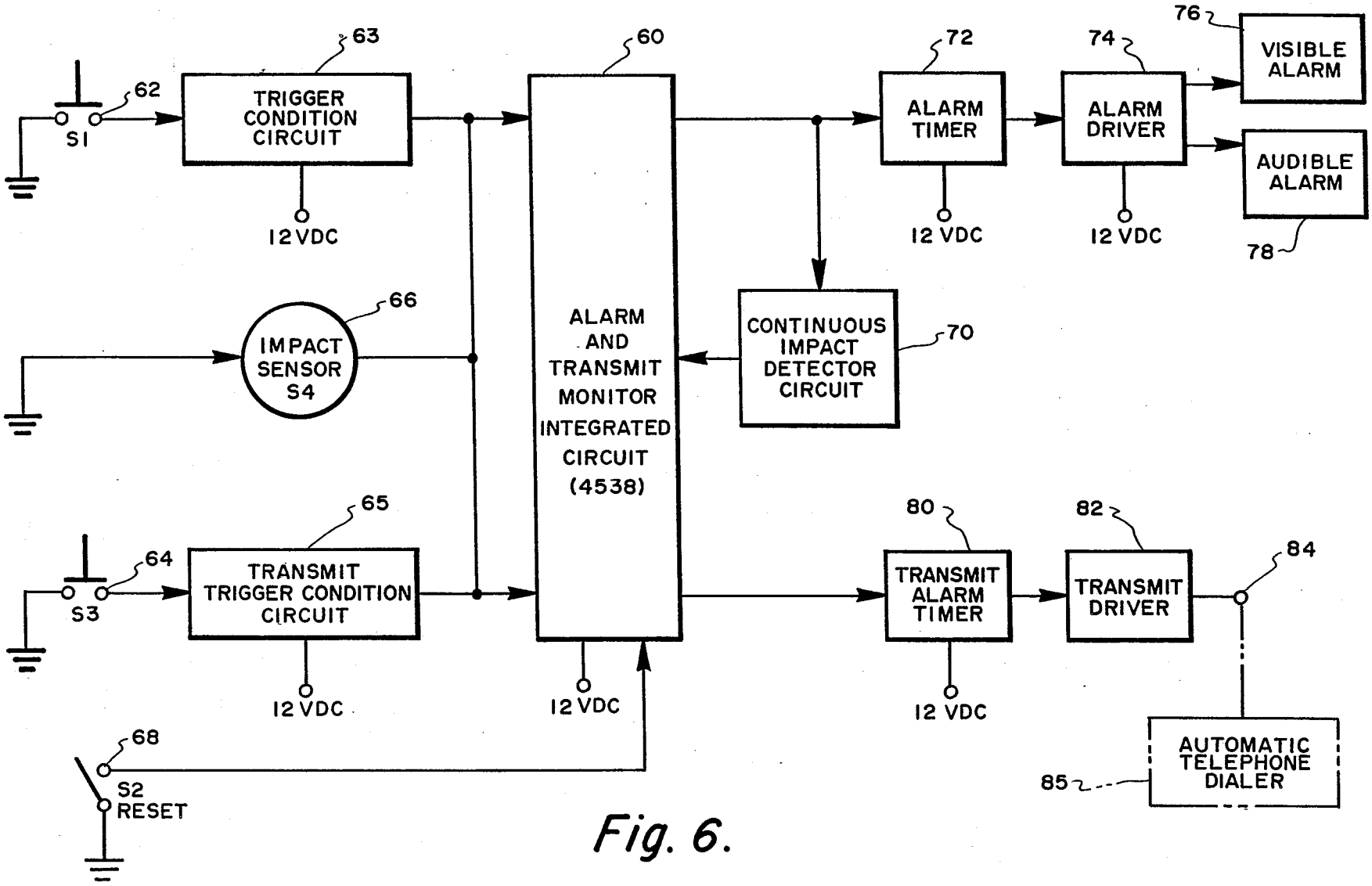
FIG. 6 is a block diagram of an alarm circuit for use in combination with the impact sensor of FIGS. 1 and 2.

A block diagram of an alarm circuit for use in the system shown in FIGS. 3 and 4 is illustrated in FIG. 6. The heart of the alarm circuit is IC (integrated circuit) 60, called the alarm and transmit monitor, connected to impact sensor 66, tamper trigger switch S1, transmit priority trigger switch S3 and reset switch S2. Impact sensor 66 (S4), or alarm switches 51, 53, activate the alarm circuit when impacts or tampering is detected. Reset input 68 from reset switch S2 resets the circuit in IC 60 during servicing of a machine or after an alarm condition has occurred.

The circuit shown in FIG. 6 includes a continuous impact detection circuit 70 which can delay continuing activation of an alarm unless impacts on the machine continue. The continuous impact detection circuit is a charging and delay circuit which must be fully charged before the alarm and transmit monitor integrated circuit 60 will turn on alarm timer 72 and transmit alarm timer 80 on permanently until turned off. Alarm timer 72 will activate an alarm for about 30 seconds and then will turn off if there are further impacts. If the impacts do not stop the alarm driver will activate a continuous alarm which may be a visible alarm, audio alarm or both. Additionally, alarm driver 74 can drive any type of visible alarm 76, such as LED 56 or audio alarm 78, in the form of a bell, buzzer, siren or other suitable alarm system.

Alternatively, the system can be connected to drive a silent remote alarm or trigger an automatic telephone dialer to dial a preprogrammed telephone number. In this case, a transmit trigger input at terminal 64 input from activation of switch S3 is conditioned by transmit trigger condition circuit 65 which may be a filter or other suitable conditioning circuit before being input to integrated circuit 60. If this circuit is connected, an alarm will activate transmit alarm timer 80 which will activate transmit driver 82 to provide an output at transmit output terminal 84 to drive some remote type of alarm, either visible or audible, if desired. An autodialer 85 connected to transmit terminal 84 will dial a preprogrammed telephone number at some remote location to transmit a message or alert security personnel. Similarly, an input from tamper switch S1 on terminal 62 is conditioned by circuit 63 and applied to IC 60.

The impact alarm system is very compact and easily installed in existing coin operated machines. The wiring 54 is connected to appropriate low level inputs for integrated circuit 60 and enclosure 40 mounted at a suitable location utilizing bracket 42 or preferably an adhesive backing. The system is small enough to be installed in coin operated telephones or other small coin operated devices. Once installed the system will detect any impact as a result of an intruder trying to invade the coinbox of the machine or vandalize the machine. Minor incidental impacts on, for example, a coin operated phone by normal lifting the receiver on and off the hook will not normally activate the circuit, or if they do it will activate for 30 seconds and then stop. Activation by minor impacts is prevented by appropriate adjustment of the impact threshold of deflectable spring 10 and adjustable screw 30. Also, continuous impact detection circuit 70 will not set off the alarm continuously if the impacts cease after the 30 second alarm caused by the initial impact.

Figure 7:
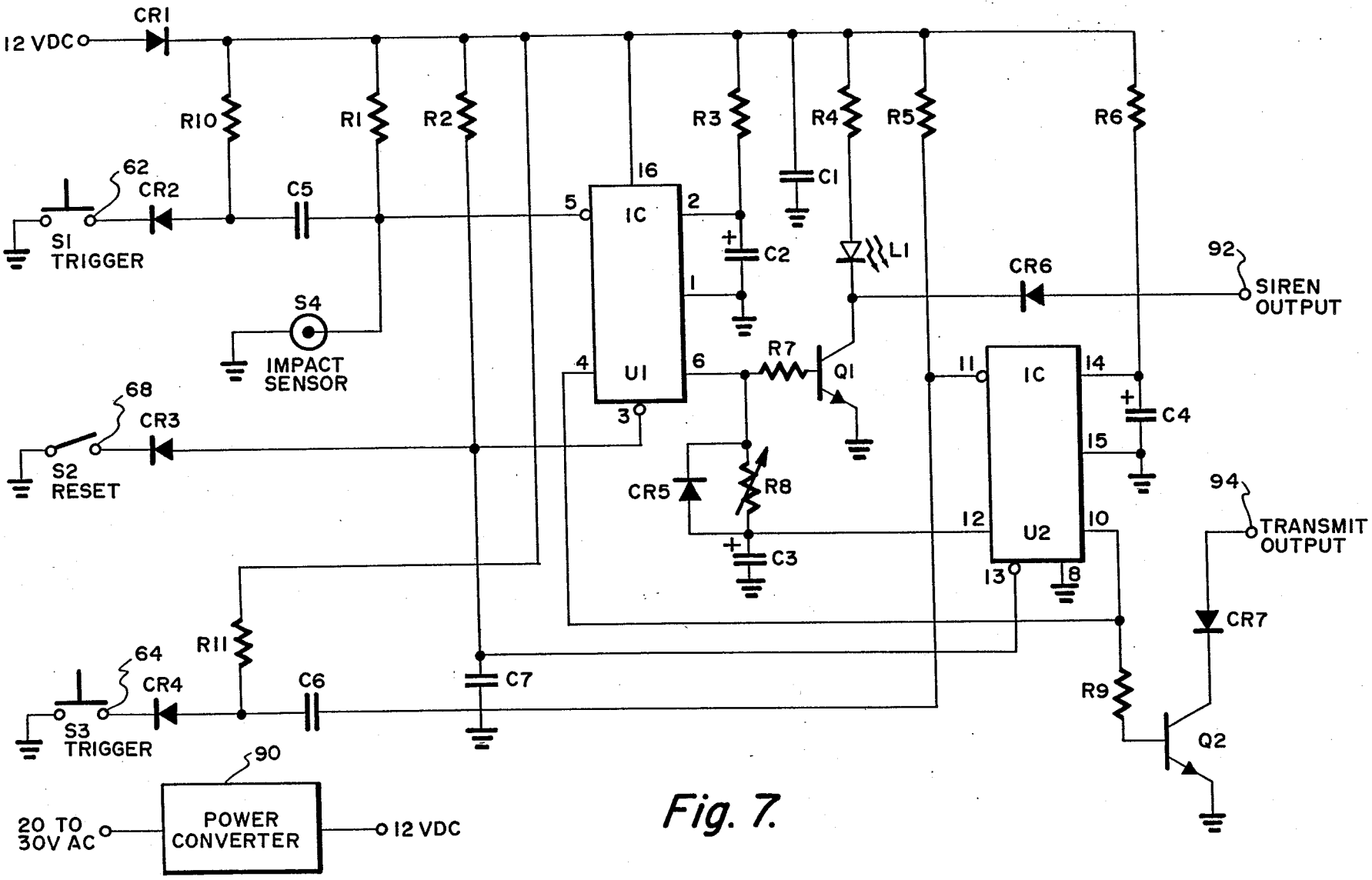
FIG. 7 is a schematic diagram of the alarm circuit of FIG. 6.

FIG. 7 is a schematic diagram of a typical alarm circuit for use in the invention. The circuit shown will operate on a 12 volt d.c. input connected to any conveniently available source in the machine where installed. If a 12 volt d.c. source is not readily available in the machine, then a power converter 90 will be used to convert the 20 to 30 volt a.c. power most machines operate on to a 12 volt d.c. output to power the system circuits.

The circuit is designed to monitor three tamper switches. Switches S1 and S3 provide trigger inputs to terminals 62, 64 respectively which can be used to monitor critical parts of a machine, such as the coinbox or the door, on coin operated equipment. These switches can be any suitable tamper sensitive switch, such as a magnetic switch, pressure switch or a microswitch. If switch S1, for example, is connected to the door of the coin operated machine tampering or unauthorized opening of the door will send a trigger signal through terminal 62 to protective diode CR2 and pin 5 of section U1 of monitoring integrated circuit to initiate a visible or audio alarm. Section U1 will provide an output to the drive circuit, including Q1, to activate light emitting diode L1 and send a signal to terminal 92 to activate any suitable audible alarm.

Switch S3 is preferably a priority switch installed to detect tampering of the most critical area of a machine. For example, this switch could be connected to the coinbox, which if tampered with will activate the switch sending a signal through diode CR4, and capacitor C6 to section U2 of monitoring integrated circuit 60. Sections U1 and U2 are respectively one-half each of a CMOS 4538 dual retriggerable monostable multivibrator integrated circuit. Triggering of switch S3 will instantly activate section U2 through terminal 64 providing an output to a driver circuit, including transistor Q2, will transmit an output to terminal 94 to activate an auto-dialer circuit to dial a preprogrammed telephone number and deliver a message. Simultaneously, pin 10 of U2 will provide a latch signal output to latch section U1 and trigger audible and visible alarms.

Impact sensor switch S4 is mounted in the enclosure for the alarm system and will detect any impacts on the machine. If there is an impact to the equipment where the system is mounted, impact sensor switch S4 will momentarily trigger pin 5 of U1 which will provide an output to activate the audible and visible alarms. The alarm duration, preferably 30 seconds, is determined by resistor R3 and capacitor C2. Pin 6 of section U1 will go high when a trigger input is received, and will turn on transistor Q1.

The system is also designed to provide an alarm, then turn off after a delay if no further impacts to the machine are received. The first impact will cause an alarm for approximately 30 seconds, and then the circuit will be reset. During the alarm time capacitor C3 will begin to charge through variable resistor R8. If impact sensor switch S4 does not detect additional impacts, capacitor C3 will not charge up to sufficient voltage to trigger pin 12 of section U2 of the monitoring integrated circuit. However, if the impacts continue and impact sensor switch S4 continues to send trigger outputs to section U1, it will cause a new alarm time to start. This causes pin 6 of U1 to remain high allowing capacitor C3 to charge to sufficient voltage to trigger pin 12 of U2. When U2 has been triggered because of continuous impacts, pin 10 will go high turning on transistor Q2 and will send an output to pin 4 of U1. A trigger output to pin 4 of U1 latches the alarm system and it will not retrigger until pin 6 of U1 again returns to a low voltage. Thus, capacitor C3 in combination with variable resistor R8 and diode CR5, functions as a continuous impact detector circuit.

The circuit is designed to minimize the effect of false alarms. A single impact will only set the alarm off once for about 30 seconds and then the circuit will be reset if no further impacts are received. It will also discourage thieves who will be forewarned that there is an alarm circuit, but can stop before they activate the alarm continuously.

Reset switch S2 can be any suitable switch, such as a toggle switch, key switch, push button, or a logic control switch connected to reset the circuit after an alarm has been set or during servicing of the machine. For example, with vending equipment the reset switch can be a magnetic contact switch operated by the key lock. When the vending machine is opened the switch resets or diables the alarm system while the machine is being serviced. Once the access door is closed and locked the reset switch will then allow the alarm circuit to be rearmed.

Thus there has been described a unique very compact impact sensing system for preventing tampering with coin operated machines. The system uses a unique impact sensor in the form of a conically tapered spring providing a wide range of adjustments allowing the impact sensing system to be easily adaptable to almost any coin operated machine. Additional protection is provided by tamper resistant switches connected to prevent entry to critical areas of a machine.

This invention is not to be limited by the embodiment shown in the drawings and described in the description which is given by way of example and not of limitation, but only in accordance with the scope of the appended claims.

What is claimed is:

1. An integrated alarm system for protecting electronic machines against tampering comprising;

an alarm circuit for activating one or more alarms; mounting means mounting said alarm circuit in said electronic machine;

one or more alarm switches for activating said alarm circuit in response to tampering;

said one or more alarm switches for activating said alarm circuit including at least one impact sensing means for sensing impact to said electronic machine;

said impact sensing means including a deflectable spring having an integrally formed conically tapered portion and a cylindrical portion tightly wound to form threads;

said mounting means including a threaded hole for mounting said deflectible spring;

said cylindrical threaded portion of spring being adjustably threaded into said hole with said conically tapered portion circumjacent an adjustable electrical contact so that the position of said conically tapered portion relative to said electrical contact can be adjusted by threading said spring into or out of said threaded hole to adjust the sensitivity range of said impact sensing means; said deflectable spring and electrical contact being connected to said alarm circuit so that a deflection of said conically tapered end of said spring that causes contact with said electrical contact causes activation of said alarm circuit.

2. The system according to claim 1 in which said deflectable spring is threadably mounted in a threaded hole in a first flange on said printed circuit board; said electrical contact being a screw mounted in a threaded hole in a second flange on said printed circuit board opposite said first flange; whereby the end of said threaded screw may be moved toward or away from said conically tapered end of said deflectable spring to adjust the threshold sensitivity of said impact sensing means.

3. The system according to claim 1 in which said one or more alarm switches includes at least two additional alarm switches mounted in said electronic machine to detect tampering with critical areas of said machine.

4. The system according to claim 3 in which one of said alarm switches is a priority alarm switch mounted to detect tampering with the most critical part of said machine.

5. The system according to claim 4 in which said priority alarm switch is mounted to detect tampering with a coinbox of a coin operated machine.

6. The system according to claim 5 in which said priority alarm switch is connected to said alarm circuit to activate an automatic telephone dialer to dial a preprogrammed telephone number and deliver a message.

7. The system according to claim 6 including means for activating said alarm after a first impact to said impact sensing means and delay activating said automatic dialer until after a predetermined number of impacts.

8. The system according to claim 7 in which said delay means includes a charging circuit; said charging circuit being charged by continuous impacts that activate said impact sensing means; said charging circuit when fully charged activating said automatic dialer connected to said alarm circuit.

9. The system according to claim 1 in which said alarm circuit includes means to stop said alarm after a predetermined period of time if no further impacts are received.

10. The system according to claim 9 in which said means to stop said alarm includes a timing circuit to set the on time of an alarm connected to said alarm circuit.

11. The system according to claim 10 in which said means to stop said alarm includes a charging circuit; said charging circuit being charged by continuous impacts that activate said impact sensing means; said charging circuit when fully charged continuously activating an alarm connected to said alarm circuit.

12. The system according to claim 11 in which said alarm circuit activates a visible alarm.

13. The system according to claim 11 in which said alarm circuit activates an audible alarm.

14. The system according to claim 1 including a reset switch for resetting said alarm circuit after activation.

15. The system according to claim 14 in which said reset switch is connected to an access door on said electronic machine; whereby opening said access door to service said machine disables and resets said alarm circuit.

16. The system according to claim 1 including delay means for delaying the alarm until said impact sensing means has been activated a predetermined number of times.

17. The system according to claim 16 in which said delay means includes a charging circuit; said charging circuit being charged by continuous impacts that activate said impact sensing means; said charging circuit when fully charged activating an alarm connected to said alarm circuit.

18. The system according to claim 17 in which said alarm circuit is constructed to activate an automatic telephone dialer to dial a preprogrammed telephone number and deliver a message.

* * * * *